United States Patent [19]

Henke et al.

[11] Patent Number: 4,955,138

[45] Date of Patent: Sep. 11, 1990

[54] UTILITY BLADE SCRAPER

[75] Inventors: David R. Henke, Maple Grove; Steven L. Thompson, Buffalo, both of Minn.

[73] Assignee: Warner Manufacturing Company, Minneapolis, Minn.

[21] Appl. No.: 297,414

[22] Filed: Jan. 13, 1989

[51] Int. Cl.[5] ..... A47L 13/04; B26B 29/02

[52] U.S. Cl. ..... 30/169; 30/320; 30/335; 15/236.9

[58] Field of Search ..... 30/169, 335, 162, 320; 15/236.01

[56] References Cited

U.S. PATENT DOCUMENTS

| | | | |
|---|---|---|---|
| D. 171,534 | 2/1954 | Ferguson | D8/6 |
| D. 223,401 | 4/1972 | Meisner | D49/23 |
| D. 237,457 | 11/1975 | Carter | D8/98 |
| D. 240,699 | 7/1976 | Gerson et al. | D7/181 |
| D. 282,881 | 3/1986 | Gringer | D32/48 |
| 2,048,603 | 7/1936 | Fancher | 145/47 |
| 2,236,323 | 3/1941 | Stachowiak | 30/169 |
| 2,895,217 | 7/1959 | Fisher | 30/169 |
| 3,171,201 | 3/1965 | Carifi | 30/335 |
| 3,665,605 | 5/1972 | Howerter | 30/169 |
| 3,708,881 | 1/1973 | Bennett | 30/335 X |
| 3,803,714 | 4/1974 | Lachowetz | 30/171 |
| 3,855,700 | 12/1974 | Gerson et al. | 30/162 |
| 3,906,625 | 9/1975 | Gringer | 30/125 |
| 4,005,525 | 2/1977 | Gringer | 30/125 |
| 4,038,719 | 8/1977 | Bennett | 16/110 R |
| 4,196,515 | 4/1980 | Sugiyama | 30/335 X |
| 4,238,883 | 12/1980 | Jacobson et al. | 30/162 |
| 4,320,576 | 3/1982 | Beermann | 30/335 X |
| 4,481,690 | 11/1984 | Simmons | 15/236 R |
| 4,558,517 | 12/1985 | Gringer | 30/169 |
| 4,706,385 | 11/1987 | Iten | 30/169 |

FOREIGN PATENT DOCUMENTS

| | | | |
|---|---|---|---|
| 2085789 | 5/1982 | United Kingdom | 15/236.01 |
| 2151531 | 7/1985 | United Kingdom | 15/236.01 |

OTHER PUBLICATIONS

Warner, 1987–1988 Decorating and Maintenance Tools Catalog (Exhibit A).

*Primary Examiner*—Frank T. Yost
*Assistant Examiner*—Rinaldi Rada
*Attorney, Agent, or Firm*—Merchant, Gould, Smith, Edell, Welter & Schmidt

[57] ABSTRACT

The utility blade scraper (20) including a handle (12) and a trigger (14) slidably mounted in a trigger receiving housing portion (13) of the handle (12). A utility knife blade (16) being mountable on a blade mounting area (28) of the trigger (14).

16 Claims, 4 Drawing Sheets

UTILITY BLADE SCRAPER

TECHNICAL FIELD OF THE INVENTION

The present invention relates to blade scraping tool used primarily for removing paint or other materials; e.g., adhesives and compounds, from surfaces, and in particular, glass or similar hard, smooth surfaces. Specifically, the invention concerns a tool particularly well suited for using standard utility knife blades.

BACKGROUND OF THE INVENTION

Various scraping tools using razor blades are currently sold and some are the subject of design and/or utility patents; e.g., U.S. Pat. No. Des. 282,881 and U.S. Pat. No. 3,855,700.

Standard single-edged razor blades are constructed of substantially thinner metal than the utility blades used in the present invention, thus limiting the force which can be applied to the scraper to remove materials due to the danger of breaking the blades.

Previous designs of utility blade scrapers typically have held the utility blade in a fixed position by clamping or by friction, with a removable cap being used to cover the scraping edge of the utility blade during storage. The cap can be easily lost, thus leaving the sharp scraping edge of the utility blade exposed. When the utility blade is held in position by friction, it is difficult to insert or remove the blade. Friction is typically used to hold the utility blade since utility blades do not have a back piece structure to help secure it in position as does the standard industrial razor blade.

Scrapers have utilized retractable razor blades. However, the design of the industrial razor blade trigger is such that the blade is held typically on both sides by the trigger, which makes it more difficult for easy removal of the razor blade. The present invention solves these and other problems associated with currently available scraper tools.

SUMMARY OF THE INVENTION

The present invention relates to a blade scraping tool used with a utility knife blade for removing paint or other materials from surfaces and in particular glass or similar hard, smooth surfaces.

A preferred embodiment of a blade scraping tool used with the utility knife blade in accordance with the principles of the present invention includes a handle having top and bottom surfaces and a front and back end. The handle has a blade housing portion having top, bottom and side surfaces, the blade housing portion being proximate the front end of the handle and being adapted to receive a utility knife blade. The blade scraping tool further includes a trigger slidably mounted in the blade housing portion for slidably moving a utility knife blade into and out of the front end of the handle. A utility knife blade is mountable on the trigger and slidably movable therewith. The trigger includes a lever cooperating with the blade housing portion for locking the trigger in at least three different locked positions and for slidably moving the trigger into and out of the locked positions. The trigger includes a blade mounting surface in front of the lever adapted to receive the utility knife blade.

One advantage of a blade scraping tool in accordance with the principles of the present invention which uses a utility knife blade is that the utility knife blade typically has a more rigid, heavy duty structure than the typical industrial duty razor blade. The utility knife blade is relatively rigid with a sharp front scraping edge and sharp points on either end of the scraping edge. The edge is typically thin enough to facilitate getting under layers of the material to be removed, so that the material will be sheared off the surface which it is attached to. In addition, the sharp points are useful for scraping in corners and tight areas along the sides of objects, such as a window frame.

Yet another advantage of the present invention is that it provides a utility blade scraper having a design which facilitates its ease of use and allows the user to get the correct angle of the utility knife blade relative to the surface being scraped so as to shear the paint or other material therefrom. A preferred embodiment of the present invention provides for maximum effectiveness in that it supports the utility knife blade during scraping relatively close to the front sharp scraping edge of the utility knife blade.

Still another advantage of one embodiment of the present invention is that it provides a means for retracting the blade into a storage position and locking the utility knife blade in a storage position so that the sharp scraping edge of the utility knife blade is not exposed. This is accomplished without the use of any additional caps or the like which can be lost. Thus the user can safely store the utility blade scraper of the present invention and not have to worry about the blade being accidentally exposed due to loss of a cap covering the blade.

Another advantage of the preferred embodiment of the present invention is that it makes it safer for the user to insert and remove the utility knife blade.

In one embodiment, the retractable trigger design includes a backstop with two spaced apart alignment pads for engaging a rear edge of the utility knife blade and a forwardly positioned center projection for insertion into a hole in the utility knife blade which facilitates retention of the utility knife blade on the trigger. The trigger slides on tracks in the blade housing portion of the handle and the utility knife blade is captured in a slot formed between the blade mounting surface of the trigger and the blade housing portion with a clearance roughly that of the thickness of the utility knife blade. Thus, the utility knife blade is securely captured between the trigger and the handle. Yet, there is little or no friction between the utility blade and the tool such that the trigger readily slides between locked positions.

In the preferred embodiment of the present invention the utility knife blade is captured between a surface of the trigger on a bottom surface of the utility knife blade and a surface of the handle on a top surface of the utility knife blade so that when the trigger is positioned in the blade changing position with the utility knife blade projecting beyond the front end of the blade, the utility knife blade is substantially free and unretained on its top surface, making the changing of utility knife blades very safe and easy. This is unlike that of industrial razor blade scrapers wherein the razor blade is typically held on both sides, thus making it more difficult for safe and easy removal of the razor blade.

Other features of a preferred embodiment of the present invention is that it enables easy assembly of the handle and the trigger. In the preferred embodiment the handle and the trigger each comprise a one piece integrally molded unit. Angled surfaces are disposed on surfaces of the trigger lever and an opening in the handle at the general area where they come into contact when inserting the trigger into the handle. Additionally, in the preferred embodiment, the trigger includes angled surfaces proximate the back end of trigger leg portions which facilitates sliding the trigger into trigger tracks in the handle.

Another advantage of one embodiment of the present invention is that it has design features which take advantage of the utility blade shape, thus making it easier to get into corners and along edges.

A preferred embodiment of the present invention is made of a two-piece construction, the handle comprising one piece and the trigger comprising a second piece. The trigger is preferably snapped into the handle during assembly without necessitating any tools and is then captured in the handle so as to not be inadvertently misplaced. However, the trigger can be nondestructively removed from the handle if desired.

A preferred embodiment of the present invention includes three utility blade locking positions: a blade storage position in which the front scraping edge of the utility knife blade is contained within the handle, a blade scraping position in which the front scraping edge of the utility knife blade is exposed, and a blade changing position in which the utility knife blade may be removed from the utility blade scraping tool. The utility knife blade can be locked in any of the three positions as required during use.

In a preferred embodiment of the present invention the handle includes a pair of spaced apart, parallel trigger tracks upon which the trigger is slidably mounted. The trigger tracks are disposed below blade guide surfaces. Additionally, in the preferred embodiment a track is provided for the trigger center projection and alignment tabs so as to prevent the utility knife blade from riding up over the alignment tabs and the pin.

Further, in the preferred embodiment, the lever is resiliently biased upwardly into locking engagement with notches in the handle whereby as the lever is moved from one locking position to another it is biased into locking engagement as it passes each of the three locking positions thereby reducing the likelihood that the trigger will be slid into an undesired position. For example, when going from the storage position to the blade scraping position, the biased nature of the lever will facilitate prevention of the trigger being inadvertently slid into the blade changing position. In the preferred embodiment, the blade scraping position includes a cam stop further preventing inadvertently sliding the trigger into the blade changing position.

Still another advantage of a preferred embodiment of the present invention is that the handle is designed with angles to match that of the blade which facilitates scraping in corners and along edges.

The preferred embodiment of the present invention facilitates molding of its parts and provides a utility blade scraper tool having a handle with a thin wall construction, but solid feel. The molded plastic design makes for an inexpensive, easy to manipulate tool.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the figures, wherein like reference numerals indicate corresponding parts throughout the several views.

DETAILED DESCRIPTION OF A PREFERRED EMBODIMENT

Figure 1:
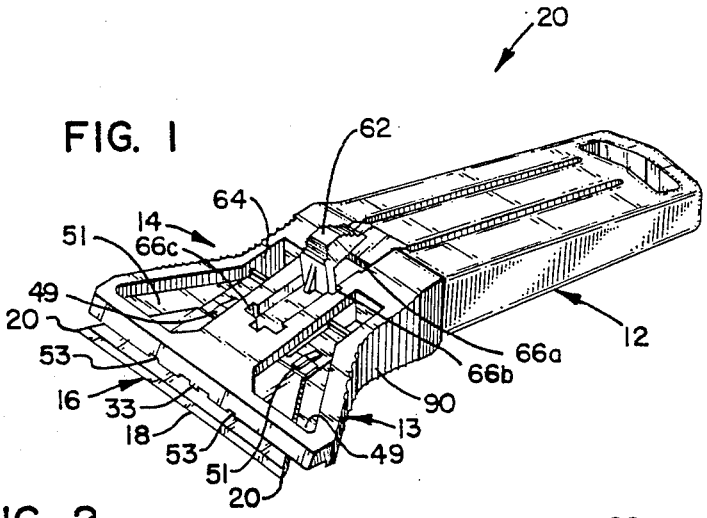
FIG. 1 is a front and top left side view in perspective of a preferred embodiment of a utility blade scraper in accordance with the principles of the present invention illustrating the utility blade scraper with an embodiment of a utility knife blade in a blade scraping position.
Figure 2:
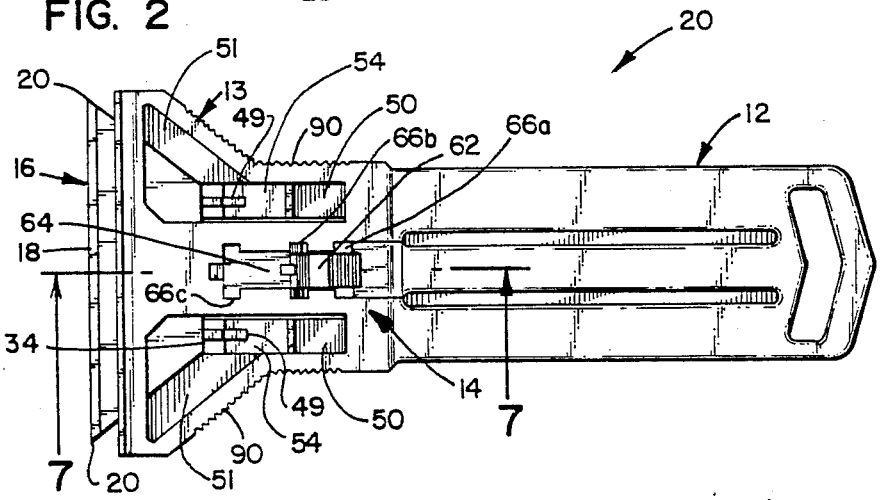
FIG. 2 is an enlarged top plan view of the embodiment shown in FIG. 1.
Figure 3:
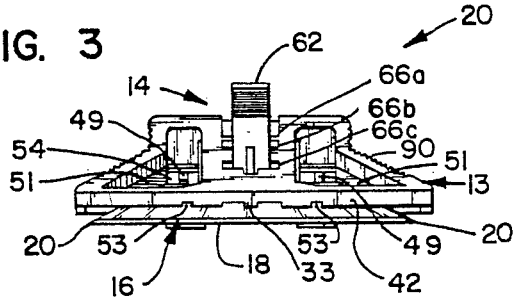
FIG. 3 is a front end view of the embodiment shown in FIG. 1.
Figure 4:
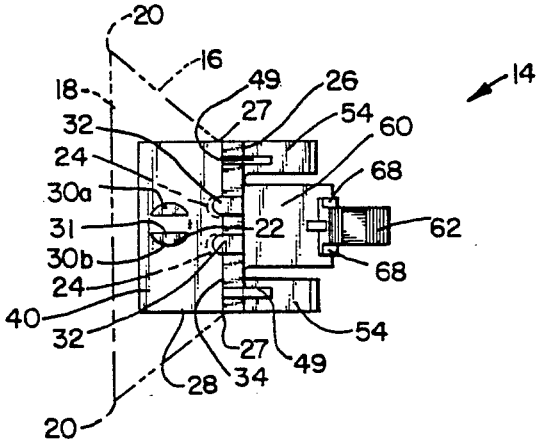
FIG. 4 is a top plan view of the trigger of the embodiment shown in FIG. 1 with the utility knife blade being illustrated mounted on a blade mounting surface area of the trigger in phantom line.

Referring now to the figures, there is illustrated a preferred embodiment of a utility blade scraping tool in accordance with the principles of the present invention, the tool being generally designated by the reference number 20. In the preferred embodiment, the tool 20 comprises two interchangeable, integrally molded unitary plastic pieces, a handle 12 and a trigger 14. The handle 12 includes a trigger receiving housing portion 13 slidably retaining the trigger 14 and a utility blade 16. As illustrated in FIGS. 1–4, the embodiment of the utility blade scraper tool 20 shown is intended to be used with an embodiment of a utility blade having a front scraping edge 18, sharp points 21 at opposite ends of the front scraping edge 18, an aperture 22, a two-spaced apart notches 24 proximate a back edge 26 of utility blade 16. As is illustrated, the utility blade 16 is a substantially flat, thin blade having tapered sides extending from the sharp points 21 to points 27 at opposite ends of the back edge 26. The utility blade 16 is mountable on a blade mounting area 28 of the trigger 14. It will be appreciated that there are slightly different styles of utility blades and that the trigger 14 can be readily modified to work with these utility blades. For example, some blades have more than one aperture 22 and any number of notches 24. In some utility blades, the aperture and notches might have differing configurations. For example, the aperture might be rectangular or square.

Figure 7:
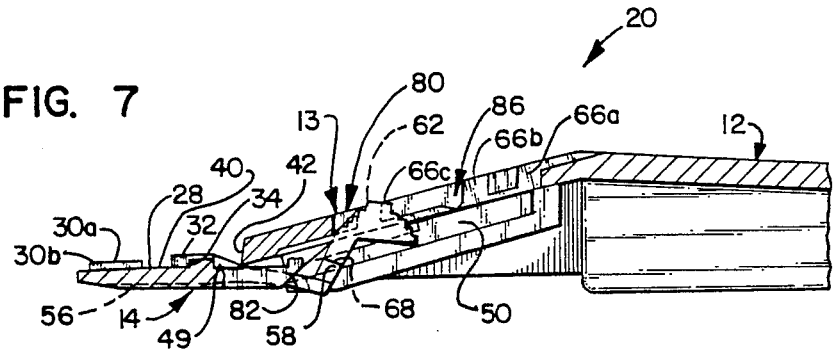
FIG. 7 is a partial, sectional view as seen generally long line 7—7 of FIG. 2 illustrating the trigger in the process of being inserted into the handle.
Figure 8A:
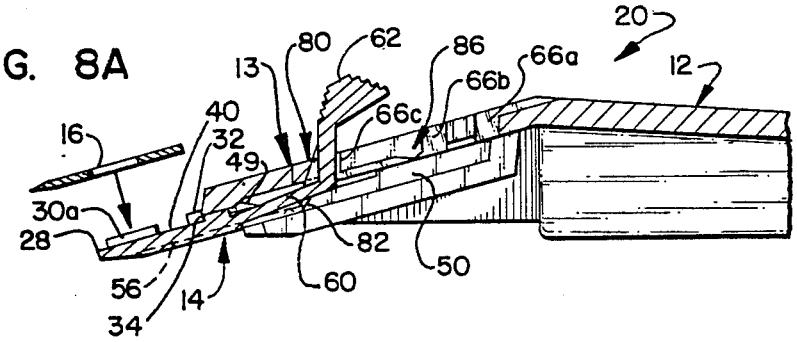
FIGS. 8A–C are views similar to that of FIG. 7 illustrating the trigger in its blade changing position, blade scraping position, and blade storage position, a utility knife blade being illustrated in general alignment with the trigger in FIG. 8A prior to positioning the utility knife blade on the trigger.
Figure 8B:
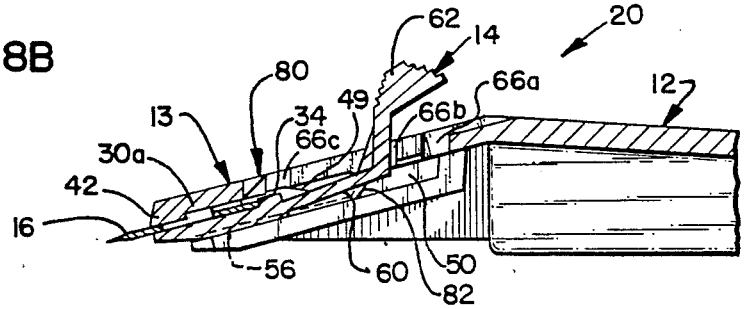
Figure 8C:
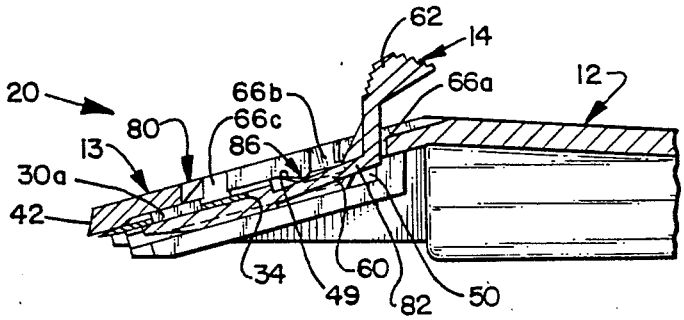
Figure 9:
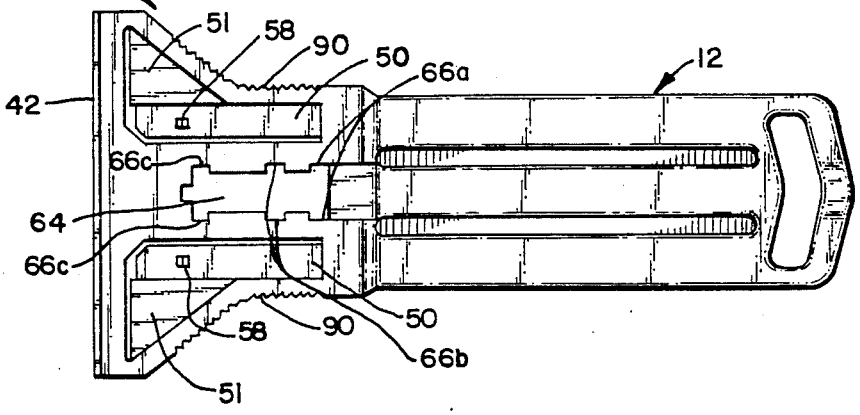
FIG. 9 is a top plan view of the embodiment shown in FIG. 1 with the trigger being removed.

As illustrated in FIGS. 7 and 8A–C, the trigger 14 is interchangeable with the handle 12. In FIG. 7, the trigger 14 is illustrated being inserted into the handle 12. Once inserted into the handle 12, the trigger 14 is slidably movable between any one of three locked positions as illustrated in FIGS. 8A–C. In 8A, the trigger 14 is illustrated in the utility blade removing position, the utility blade 16 being illustrated in general alignment with center projections 30*a,b* on the blade mounting area 28 so that when placed onto the blade mounting area 28, the projections 30*a,b* will project into the aperture 22 of the utility knife blade 16 and prevent the utility knife blade from sliding off the front end of the trigger 14. In alternate embodiments, the projections 30*a,b* may comprise a single projection or pin. In addition, when aligned with the center projections 30*a,b*, the notches 24 of the utility blade 16 are aligned with alignment tabs 32 disposed in a spaced apart fashion along a back wall 34, also referred to as a backstop, of the blade mounting area 28. The back wall 34 provides for abutting engagement with the back edge 26 of the utility blade 16. The projections 30*a,b* and the alignment tabs 32/back wall 34 cooperate to prevent movement of the utility blade 16 parallel to a blade receiving surface 40 of the blade mounting area 28 and to prevent rotational movement of the utility blade 16. FIG. 8B illustrates the trigger 14 in the blade scraping position with the utility blade 16 projecting beyond a front end 42 of the utility blade scraping tool 20. FIG. 8C illustrates the trigger 14 in the storage position such that the utility blade 16 does not project beyond the front end 42 of the utility blade scraping tool 20.

Figure 6:
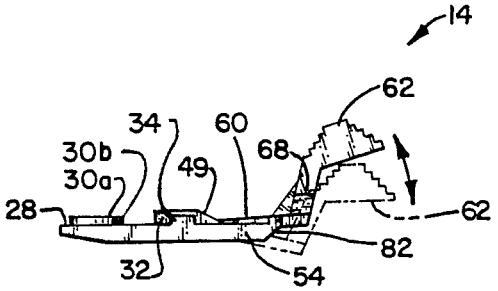
FIG. 6 is a side view of the trigger shown in FIG. 4 with the trigger lever being shown in its normal locked position and being shown in phantom line in its depressed unlocked/released position.
Figure 5:
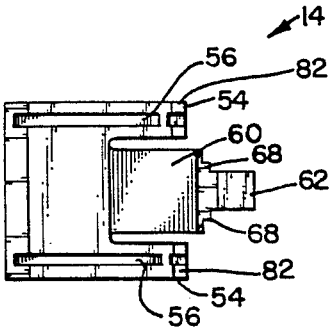
FIG. 5 is a bottom plan view of the trigger shown in FIG. 4.

Referring now more particularly to FIGS. 4–6 and 9–10, the trigger 14 is slidably mounted in the blade receiving housing portion 13 on two spaced apart trigger receiving tracks 50 disposed below blade guide surfaces 51 which assist in supporting a bottom surface of the utility blade 16 when in the housing portion 13. In addition, the center projections 30*a,b* and the alignment tabs 32 slide in a pin receiving groove 52 of the handle 12. Alignment ribs 49 on the trigger 14 slide in grooves 53 of the handle 12. Bottom surfaces of leg portions 54 of the trigger 14 include grooves 56 slidably aligned with stops 58 on the trigger tracks 50 so as to prevent the trigger from being inadvertently pushed beyond its blade removing position. Separated from the leg portions 54 of the trigger 14 is a central resilient portion 60 of the trigger 14 including a lever 62 rising up from the trigger. The lever 62 projects through an elongated opening 64 in the handle 12. The elongated opening includes three sets of spaced apart notches 66*a,b,c*. The lever 62 includes shoulder portions 68 which slide on the pin receiving groove 52 such that the resiliently mounted lever 62 is forced downwardly away from its normal locked position and toward a depressed unlocked/released position as illustrated in phantom line in FIG. 6. (The amount of depression is exaggerated in FIG. 6 for purposes of illustration.) As the trigger 14 is slid along the handle 12, the resiliently mounted lever 62 is biased upwardly such that when the shoulder portions 68 of the lever 62 are aligned with the notches 66*a,b,c*, the lever 62 will be biased into its normal locked position as illustrated in FIG. 6 by the solid outline of the lever 62. To release the trigger 14 and continue sliding the trigger 14, the user pushes the lever down into its unlocked position as generally illustrated in FIG. 6 by the phantom line such that the shoulders 68 no longer engage walls of the notches 66*a,b,c*.

In the preferred embodiment, the center projections 30*a,b* form a groove 31 therebetween. The groove 31 is alignable with and slidably receives a safety rib 33 on an underside of the blade 12. This provides additional support for the utility knife blade 16.

It will be appreciated that the utility knife blade is supported between the blade receiving surface 40 of the blade mounting area 28 and the bottom surface 41 of the handle 12.

In the preferred embodiment, the pin receiving groove 52 is angled/inclined at location 80 to facilitate insertion of the trigger 14 into the handle 12 as generally illustrated in FIG. 7. The trigger 14 is inserted into the handle 12 by inserting the lever 62 through the pair of notches at the blade changing position 66*c*. In addition, a back end of the trigger leg portions 54 is also angled/inclined at location 82 so as to facilitate insertion of the leg portions 54 onto the trigger tracks 50 of the handle 12. The trigger 14 is removed by moving the trigger to the blade changing position 66*c*, forcing down on the front of the trigger 14, depressing the lever 62, and sliding the trigger forward.

Figure 10:
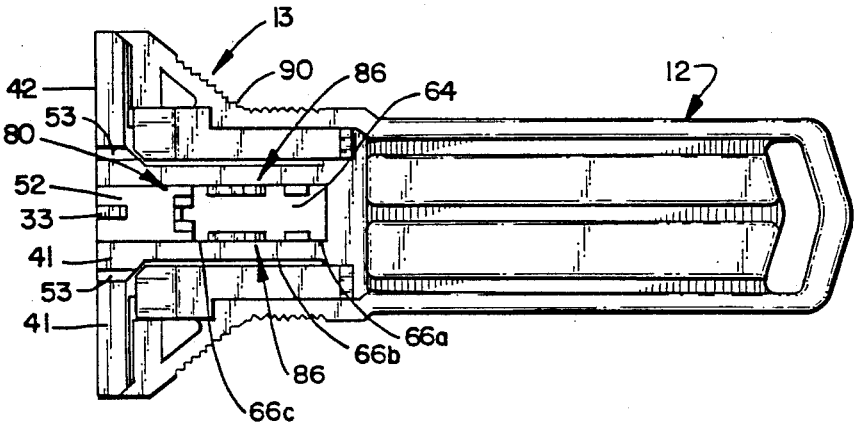
FIG. 10 is a bottom plan view of the embodiment shown in FIG. 9 with the trigger removed.

As further illustrated in FIG. 10 a cam stop 86 is present at the pin receiving groove 52 proximate the scraping position so as to facilitate guiding the trigger 14 into the scraping position 66*b*. The cam stop 86 provides an additional wall surface for engaging the shoulders 68 of the trigger 14. As a result, the trigger 14 must be depressed more to get by the cam stop 86.

As is generally illustrated in FIG. 1, a side portion of the blade receiving housing portion 13 is ribbed at location 90 so as to facilitate gripping of the utility blade scraping tool. In addition, the blade receiving housing portion 13 is flared outwardly proximate the front end to approximate the incline (angle) of the utility knife blade 16. In addition, the blade receiving housing portion is tapered so as to be reduced in thickness toward the front end of the utility blade scraping tool 20, a top surface of the blade receiving housing portion 13 being tapered gradually downward.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A blade scraping tool used with a utility knife blade, comprising:

(a) a handle having top and bottom surfaces and including a blade housing portion having top, bottom and side surfaces, the blade housing portion being proximate a front end of the blade scraping tool and being adapted to receive a utility knife blade, the blade housing portion including diverging inner side surfaces diverging away from each other toward a front end of the blade housing portion;

(b) trigger means slidably mounted in the blade housing portion intermediate of the top and bottom surfaces of the blade housing portion for slidably moving a utility knife blade into and out of the front end of the blade housing portion of the handle, a utility knife blade being mountable on the trigger means and slidably movable therewith, the utility knife blade being mounted on the trigger means with its scraping edge extending substantially perpendicular to a longitudinal axis of the blade scraping tool, the trigger means including:

(i) lever means accessible from outside the blade housing portion cooperating with the blade housing portion for locking the trigger means in at least three different locking positions and for slidably moving the trigger means into and out of the locking positions, the locking positions including a storage position in which the scraping edge of the utility knife blade is contained within the blade housing portion, a blade scraping position in which the scraping edge of the utility knife blade is exposed, and a blade changing position in which the utility knife blade may be removed from the trigger means;

(ii) a blade mounting surface area in front of the lever means adapted to receive a utility knife blade, the blade mounting surface area including projection means for preventing forward or backward movement of the utility knife blade relative to the blade mounting surface;

(c) wherein the blade housing portion includes at least one track means for supporting the trigger means while it is slidably mounted in the blade housing portion.

2. The blade scraping tool of claim 1 wherein the handle is formed of a one-piece molded construction.

3. The blade scraping tool of claim 2 wherein the trigger means is formed of a one-piece molded construction.

4. The blade scraping tool of claim 1 wherein the blade housing portion includes ridge-shaped projections disposed on the sides of the blade housing portion, aiding the user to firmly grip the blade scraping tool.

5. The blade scraping tool of claim 1 wherein the bottom surfaces of the handle and a front end of its blade housing portion are located substantially in the same plane, the blade scraping tool being thickest at the juncture of the blade housing portion and the handle and the blade housing portion being substantially thinner at the front end of the tool, aiding the user to employ the tool in areas with little clearance.

6. The blade scraping tool of claim 1 wherein the blade housing portion includes an elongated opening in the top surface with a plurality of notches paired on opposing sides of the elongated opening, the pairs of opposing notches defining the locking positions of the trigger means.

7. The blade scraping tool of claim 6 wherein the lever means of the trigger means is adapted to mate with the notches in the elongated opening in the blade housing portion, thus locking the trigger means in one of the locking positions.

8. The blade scraping tool of claim 7 wherein the lever means of the trigger means extends through the elongated opening in the blade housing portion, allowing the user to lock and unlock the trigger means so as to slidably move the trigger means.

9. The blade scraping tool of claim 7 wherein the lever means is disposed substantially perpendicular to a plane containing the blade mounting area of the trigger means, the lever means protruding through the elongated opening in the top of the blade housing portion and engaging the notches in the elongated opening which define the locking positions when the tool is locked in one of the locking positions.

10. The blade scraping tool of claim 1 wherein the trigger means is formed of a one-piece molded construction of a resilient material.

11. The blade scraping tool of claim 1 wherein the trigger means is removable from the blade housing portion without disassembling the blade scraping tool.

12. The blade scraping tool of claim 11 wherein the blade mounting area of the trigger means and the blade housing portion, when assembled together, cooperate so as to retain a utility knife blade in the tool.

13. The blade scraping tool of claim 1 wherein the track means are disposed parallel to each other and in the same plane, the plane disposed intermediate of the top and bottom surfaces of the blade housing portion, and wherein the track means includes stops disposed on the top surface of the track means and proximate the front end of the track means.

14. The blade scraping tool of claim 13 wherein the trigger means includes two or more grooves formed on a bottom surface of the trigger means, the grooves adapted to ride over stops of the track means; the grooves and the stops cooperating to prevent unintentional removal of the trigger means from the blade housing portion.

15. The blade scraping tool of claim 1, wherein the projection means includes a backstop with two spaced apart alignment tabs and forwardly positioned spaced apart center projections, the alignment tabs and center projections being respectively alignable with corresponding notches and a circular void of a utility knife blade.

16. The blade scraping tool of claim 1 wherein the utility knife blade is slidably supported between two intersurfaces of the blade housing portion.

* * * * *

UNITED STATES PATENT AND TRADEMARK OFFICE

CERTIFICATE OF CORRECTION

PATENT NO. : 4,955,138

DATED : Sep. 11, 1990

INVENTOR(S) : Henke et al.

It is certified that error appears in the above-identified patent and that said Letters Patent is hereby corrected as shown below:

In Column 4, line 28, "long" should read --along--; line 57, insert --the-- after the word "of".

Signed and Sealed this

First Day of December, 1992

*Attest:*

DOUGLAS B. COMER

*Attesting Officer*

*Acting Commissioner of Patents and Trademarks*